United States Patent [19]

Mastriani et al.

[11] 3,977,284

[45] Aug. 31, 1976

[54] COMPACT SLITTING MECHANISM

[75] Inventors: Elvin A. Mastriani, Roseland; Robert E. Mastriani, Long Valley, both of N.J.

[73] Assignee: Arrow Converting Equipment, Inc., Fairfield, N.J.

[22] Filed: June 3, 1975

[21] Appl. No.: 583,469

Related U.S. Application Data

[63] Continuation-in-part of Ser. No. 422,433, Dec. 6, 1973, Pat. No. 3,921,488.

[52] U.S. Cl. ..... 83/495; 83/505; 83/698

[51] Int. Cl.[2] ..... B26D 1/22; B26D 1/40; B26D 7/26

[58] Field of Search ..... 83/505, 506, 504, 508, 83/508.1, 495, 676, 698

[56] References Cited

UNITED STATES PATENTS

| | | | |
|---|---|---|---|
| 2,000,175 | 5/1935 | Johnstone et al. | 83/505 X |
| 2,712,852 | 7/1955 | Carter | 83/506 X |
| 2,802,528 | 8/1957 | Mastriani | 83/505 X |
| 2,997,906 | 8/1961 | Burk et al. | 83/506 |
| 3,197,992 | 8/1965 | Taniguchi | 83/505 X |
| 3,564,962 | 2/1971 | Wingen | 83/506 |
| 3,777,607 | 12/1973 | Schofield | 83/506 X |

*Primary Examiner*—Willie G. Abercrombie
*Attorney, Agent, or Firm*—Sommers & Sommers

[57] ABSTRACT

This invention relates to compact slitting mechanism units structured so to enable a plurality of such units to be positioned in abutting, close, parallel relation, for narrow width cutting, slitting or other operations, said units including pressure chambers and knife holding and aligning mechanisms with structural features enabling knife elements and actuator cylinder mechanisms of the units to be mounted in essentially unitary axially aligned relation, and having novel means for mounting and actuating the knives and for enabling removal and replacement of any knife of any unit without disassembly of parts, in a safe convenient and simple manner, the pressure chamber-knife-holding mechanism assemblies being structured of equal widths, to facilitate side-by-side positioning of plural assemblies thereof, enabling narrow width contacting operations to be performed on surfaces to be slitted or otherwise multiply so contacted thereby.

16 Claims, 11 Drawing Figures

COMPACT SLITTING MECHANISM

BACKGROUND OF THE INVENTION

This application is a continuation-in-part of copending application, Ser. No. 422,433, filed Dec. 6, 1973, for "Compact Slitting Mechanism" assigned to the same assignee as the instant application, now U.S. Pat. No. 3,921,488.

This invention relates to mechanisms to be reciprocated in multiple unit form, for procedures such as scoring, slitting and cutting materials. An object of the invention is to overcome disadvantages of complexity, inaccuracy and inefficiency of prior art structures intended for such uses, wherein the knife positioning and actuating mechanisms were bulky, unwieldy, complex structures, making use and replacement thereof a difficult, and unsafe, inaccurate, procedure and not adapted for simple and efficient assembly in multiple unit groups in close parallel arrangement.

The present invention provides a novel, safe, higly efficient, compact mechanism for achieving narrow slitting, scoring, cutting and other procedures to be achieved in a simple, safe, accurate and convenient manner due to novel structural features of pressure chambers and knife holders and actuators powered thereby for actuation in straight line, plural unit arrangements, so that an assembly of any desired number of such actuator units may be achieved in multiple side-by-side abutting, essentially unitary assembly as desired and enabling ready insertion or removal of the knife of any of the assembly units without interfering with the others or with the multiple unit arrangement.

The invention provides novel means for mounting knives and their actuators as essentially integral units, each knife being essentially fully exposed to the ambient atmosphere, for cool running and for reducing friction to a minimum, at the same time facilitating cleaning thereof and further enabling individual knives and holders to be readily viewed and removed and replaced in a safe, simple and convenient manner. The invention further enables the actuator-knife mechanism to be formed of sturdy features so that they may be assembled in essentially unitarily plural contiguous side-by-side arrangements while enabling individual units to be subtracted and added simply, safely and without requiring complex disassembly of parts as is required in prior structures in this art.

The invention further provides novel means for positioning each knife in its holder in a novel seating and holding arrangement, the knife insertion and removal path being clearly visible to the user at all times; any knife may be readily withdrawn from and re-inserted into its unit safely and without exercise of special dexterity or having to guess where the removal and reinsertion paths and areas are located.

BRIEF DESCRIPTION OF THE DRAWINGS

Embodiments of the invention are illustrate, by way of example, in the drawings, wherein similar reference characters indicate like parts, and wherein.

DESCRIPTION OF PREFERRED EMBODIMENTS

Figure 1:
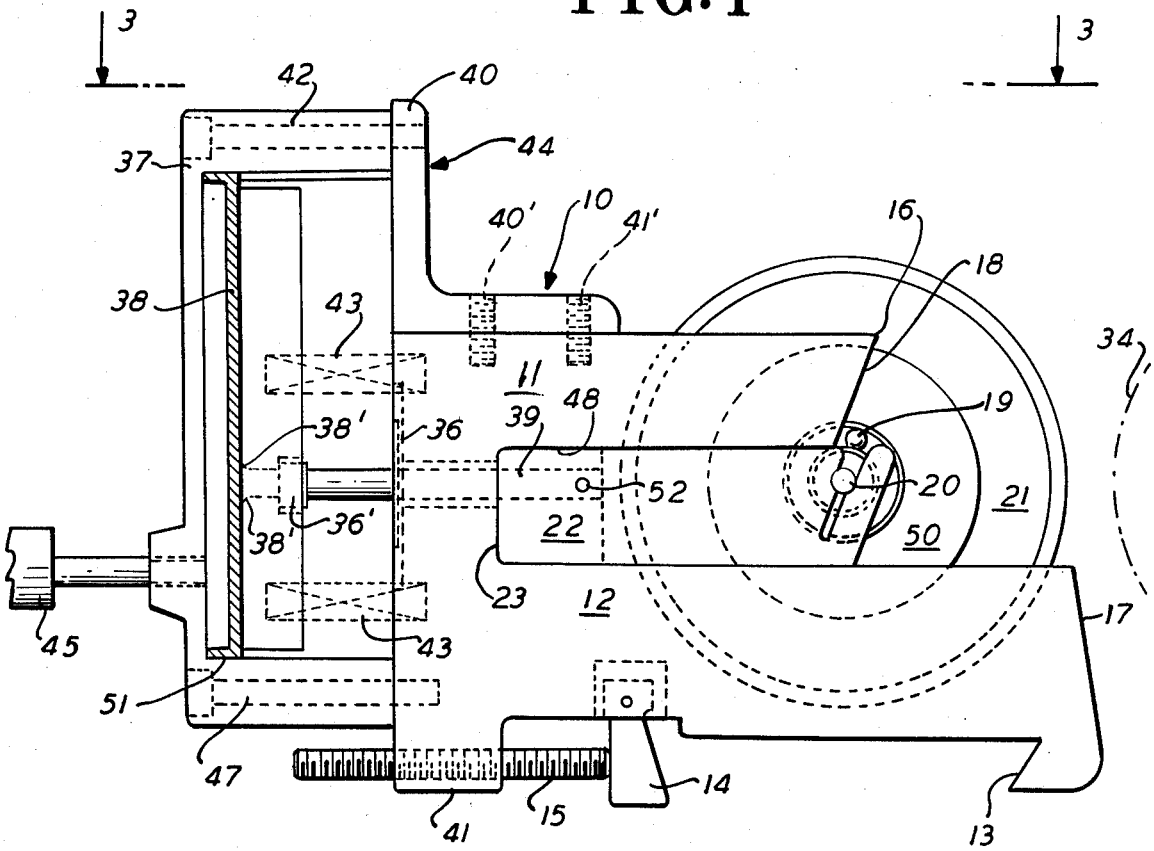
FIG. 1 is a side elevational view of a mechanism unit embodying the invention.

As shown in the drawings, (FIG. 1) the invention comprises a C-shaped knife casing 10, preferably formed unitarily of suitable metal or other material (or of a number of parts secured together) to define a pair of parallel spaced arms 11, 12, provided with the cut-out axial keying portion 13 or other means, for facility of mounting the casing 10 and its power source 37, as single units or in multiple units (FIG. 3) in a side-by-side, essentially unitary, relation on a beam or other part of the machine, in connection with which the invention is used, received in said cut-out keying portion 13. A movable link 14 and adjustable pin 15 cooperate with said portion 13 for so mounting the parts on a beam or other part of a machine on which U.S. Pat. No. 3,921,488 was issued on Nov. 25, 1975 for keying the mechanism thereto.

Figure 4:
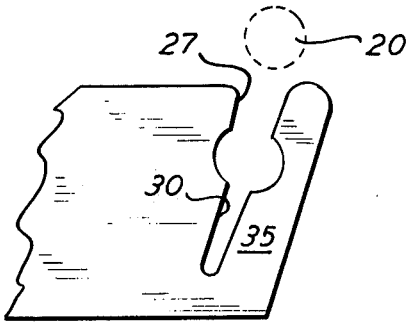
FIG. 4 is a fragmentary, side elevational view of a knife holder which may be used in accordance with the invention, showing, schematically, the (dotted) knife wheel axle 20 about to be inserted into (or just removed from) the slotted end of knife holder 22.
Figure 5:
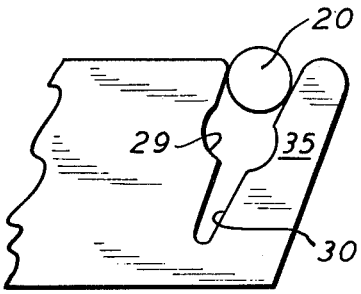
FIG. 5 is a similar view, showing the axle as initially partially inserted into (or removed from) the slotted end of the knife holder.
Figure 6:
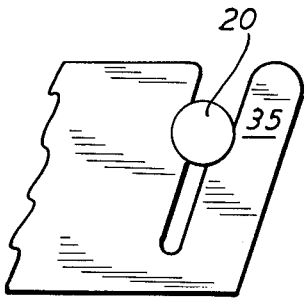
FIG. 6 shows the knife seated therein.
Figure 7:
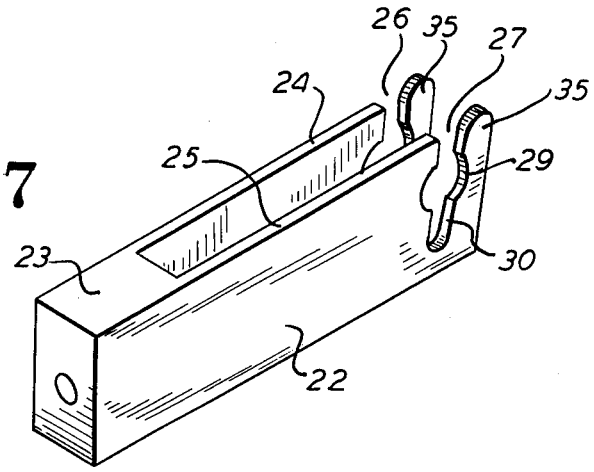
FIG. 7 is a perspective view of a knife holding member embodying the invention.
Figure 8:
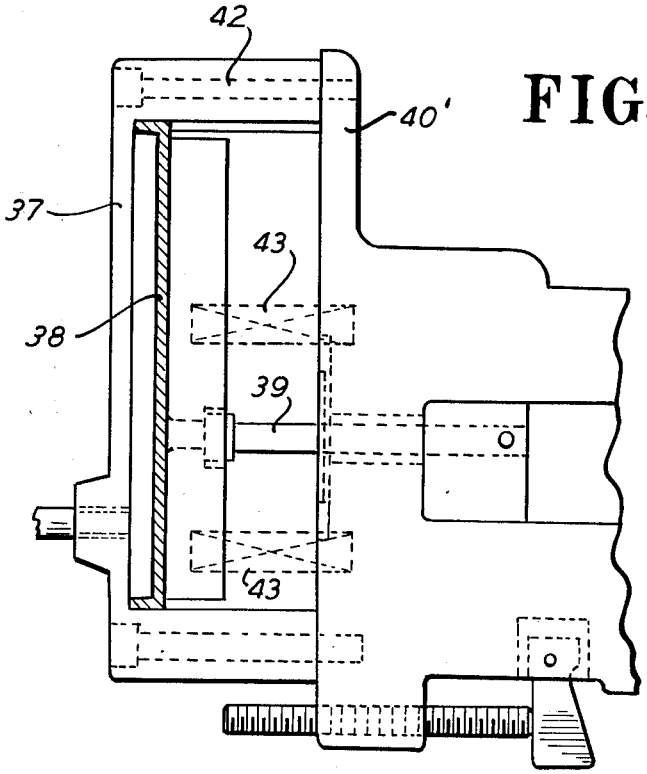
FIG. 8 is a fragmentary side elevational view of a further form of the invention.

The upper casing arm 11 is preferably foreshortened at the free end 16 thereof inwardly of the free end 17 of the lower arm 12. In addition thereto, the foreshortened end 16 of said upper arm is preferably angularly upwardly, outwardly, inclined as at 18 (FIG. 1) to facilitate movement of the stubshaft or axle 20 of the knife 21 in a direct path of insertion or removal thereof relative to the knife holder 22 (FIGS. 4, 5, 6). The knife holder 22 (shown in perspective in FIG. 7) may be formed of a block of solid material or of several parts, to define a closed, relatively solid, end portion 23, with bifucated, spaced, parallel sides or arms 24, 25 extending therefrom, for a purpose presently explained. Said bifucated arm members 24, 25 are provided with vertical entry-exit slots 26, 27 adjacent their free ends (FIGS. 4–7) of a width at their upper ends (FIGS. 4) substantially equal to or slightly less than the diameter of the shaft or axle 20 of the knife, so as to preferably require some force in the knife insertion and removal operations. The knife may then be moved down in the slots to register with the enlarged, that is wider than entry slot 27, (FIG. 5) seating portion 29, proportioned to receive and hold the axle preferably firmly and frictionally (FIG. 6). The slot is provided with the narrow lower end 30 (FIG. 4) below seating portion 29; the knife insertion-removal path is thus always visible.

The knife holder parts above described are preferably made of springy material so that the operation of inserting and removing the knife is a safe, simple and efficient one, and may be repeated time and again without reducing the efficiency of the parts or procedures. As will be noted from the above description and the drawings, the slots 26, 27, 29, 30 thus split the free end portions of the parallel walls 24, 25 of the holders 22 to define tangential holder fingers 35 (FIG. 7) which so flex on insertion (and on removal) of the axle of the knife, to facilitate the operation and assure the secure seating of the knife in the holder 22. The slots are (FIG. 1) preferably upwardly inclined at an angle generally corresponding with that of the inclined end 18 of the upper arm 11, providing a visual and physical guide (18, 27) for safe and simple knife insertion and removal.

The knife holder 22 and the axial slot 48 (FIG. 1) provided in casing 10 for receiving the same, are preferably formed of complementary dimensions to facilitate and insure smooth reciprocation of the knife holder 22 in said casing responsive to actuation of a power source 37, which may be pneumatic, hydraulic, fluid or other means, connected to a manifold or other source by cable 45 (FIG. 2) or other means, actuated and controlled by the operator, or automatically, to reciprocate power source piston 38 or other driving means and thus reciprocate the shaft 39, connected thereto by suitable means, as be peening 38' said shaft to the piston head 38; the shaft 39 is connected (at its other end as by roll pin) to the knife holder 22.

Figure 3:
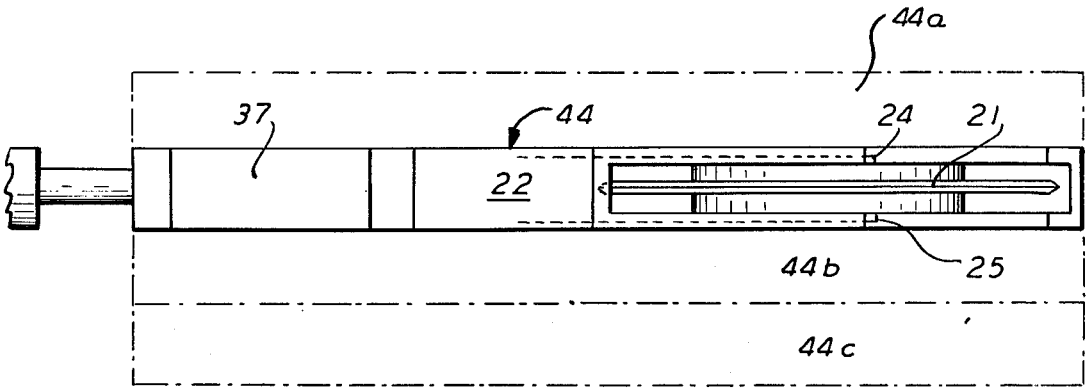
FIG. 3 is a top plan view showing, in dotted lines, a plurality of mechanism units embodying the invention, in essentially unitary side-by-side arrangement, taken at line 3—3 of FIG. 1.
Figure 11:
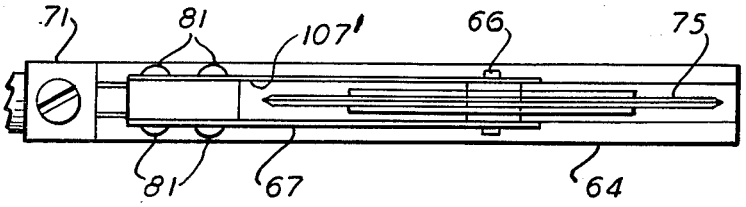
FIG. 11 is a top plan view, taken at line 11—11 of FIG. 9.

Suitable bearing and/or supporting means 36, 36' (FIG. 1) may be provided in casing 10 and power source 37, wherein shaft 39 may be readily reciprocated on actuation of the power source 37, to move the shaft 39 and knife holder 22; thus the knife 21 will be moved into operative engagment with the web, roll or other object 34 to be operatively contacted or engaged by knife 21. Each of the arms 24, 25 of knife holder 22 is (FIGS. 3–9) slotted or open to freely rotatably receive the knife 21 therein, the (bifurcated) knife holder being proportioned to freely slidably interengage with the surfaces of the casing defining slot 48 (FIG. 1) when actuated by source 37, the holder 22, 67 being preferably proportioned to be, as shown in FIGS. 3 and 11, of less width than the arms 11, 12 of casing 10.

The power source 37 may be connected to the casing 10 by suitable means, such as brackets 40, 41, which may be formed unitarily with the casing 10 and extend laterally at the closed end thereof and may be connected to the power source 37 as by bolts 42, 47 (FIG. 1) to thus assembly the mechanism unit. The brackets may be formed separately (FIG. 1) as at 40', and connected to casing 10 by means such as bolts 31, 30; further bolt or keying means may be used if desired.

The knife holder 22 may be normally urged to seated position at the closed end 23 (FIG. 1) of the C-shaped casing 10, by return spring or other means 43, engaging the power source piston head 38 and casing 10. The knife 21 may (FIG. 1) be mounted on its axle 20 by antifriction means such as 19, in hub 50. The interface 51 (FIG. 1) of the piston head 38 and the inner wall of cylinder 37 may be lubricated by any suitable means such as graphite or other grease or lubricant.

The parts are preferably proportioned so that the knife axle 20 will be substantially equal to or of slightly less length than the transverse dimension of the knife holder 22, which, in turn, may (FIG. 3) be of slightly less width than or correspond with the width of, the casing 10, its brackets 41, 43 and power source 37. Thus a multiple of such units (FIG. 3) 44, 44*a*, 44*b*, 44*c* may be positioned or assembled in compact immediate contacting and close parallel relation so that the knives or other members 21, thereof, in turn, will thus be juxtaposed in close parallel relation for desired ranges of slitting, cutting or other operations. Multiple units may be spaced apart if and to the extent desired for any purpose, by use of suitable spacers therebetween.

The power source 37 may be connected, as by hose, cable or other means 45 (shown broken in FIGS. 1 and 2) and coupling or other means 46 to a manifold or other source of power, in any convenient or desired manner.

Figure 2:
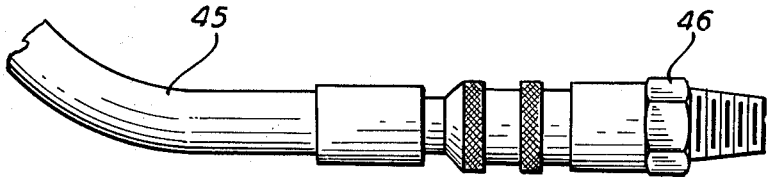
FIG. 2 is an elevational view of part of a pneumatic or other cable for powering the mechanism.

It will be noted from the foregoing that the device of this invention enables (FIGS. 4, 5 and 6) the simple and accurate insertion of the knife into the knife holder 22, initial insertion of the knife axle being made clear of the foreshortened and angular edge 18 of the upper arm of the casing 10 and inserted into the lead slots 26, 27 of the bifucated arms 24, 25 of the holder 22, the parts being proportioned so that, as shown in FIG. 1, when the knife holder 22 is disposed against or near the closed end of axial slot 48 of casing 10 (FIG. 1) slot 27 of the knife holder will be clearly visible and disposed beyond and outwardly of the lower end of the inclined edge 18 of upper arm 11 of casing 10, to facilitate knife insertion and and removal procedures. On initial (FIG. 5) insertion of the knife axle into slot 27 it slightly spreads or frictionally engages the slot. Further downward movement of the knife will seat it (FIG. 6) into the (FIG. 5) widened conforming to the axle seating contours or seating portion 29 of the slot, to frictionally hold the axle therein.

The knife holder fingers 35 press in the direction of the closed end 23 of the holder to grip the axle in its eating slot 29; the knife, provided with roller bearings or other anti-friction means 19 (FIG. 1) will freely rotate its axle when so seated and held in the holder 22.

The procedure for removing a knife and replacing it is essentially a reversal of the insertion procedure; thus one need only move the knife axle upwardly out of the seated (FIG. 6) position, past (FIGS. 5, 4) the inclined foreshortened edge 18 of the upper casing arm 11, to remove or replace the knife. As will be noted from FIG. 1, the structural features of the device of the invention expose substantial surfaces of the knife, in operation, to ambient air, automatically cooling and cleaning the knife in practice. It will be further noted that the power cylinder-knife-actuating train is a direct-line power drive operation, and that the reciprocation of the knife holder in the casing to thus perform its slitting, cutting, scoring or other procedures in accordance with this invention, is an accurate, automatically aligned operation. The operator of the device of the invention does not need to have special training or to exert any special dexterity or to engage in unsafe operations in the knife removal and replacement procedures; the knife-receiving parts are clearly visible to the operator at all times, as is the direct-line path for insertion and removal. Thus risk of injury to the operator and error and ensuing damage to the parts is avoided.

The shaft 39, piston head 38 connection 38' is an essentially unitary one, as is the pinned or other connection with the knife holder 22 and thus the knife 21 as well; risk of lost-motion, vibration, and inefficiencies, as in devices heretofore proposed in this art, are obviated. In the structure of this invention the power source 37 may be a compressed air-cylinder piston, or other actuator means.

Figure 9:
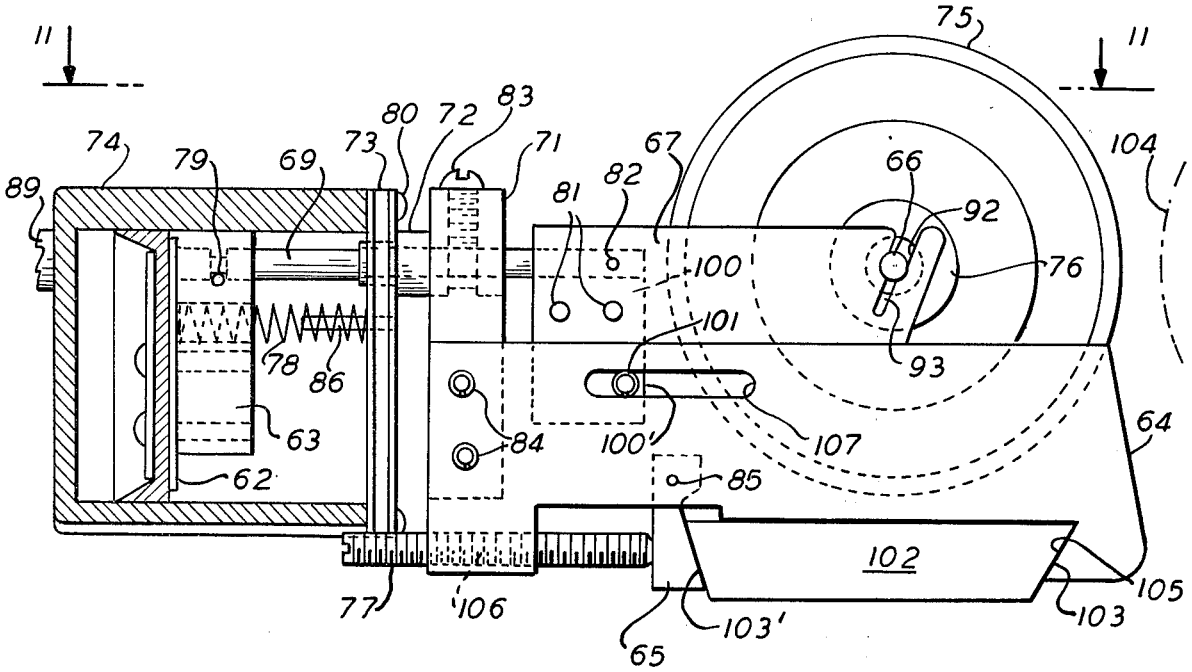
FIG. 9 is a vertical, partly sectional, elevation view of another form of the invention.
Figure 10:
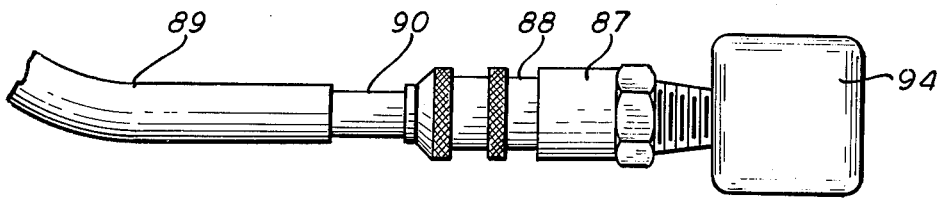
FIG. 10 is a fragmentary elevational view of part of a pneumatic or other power cable for use therewith.

In the form shown in FIGS. 9, 10 and 11, the pressure chamber 74 may be actuated from a suitable pressure source such as, for example manifold 94 (FIG. 10) so that compressed air or other power source may be coupled to piston chamber 74 by suitable means such as plug, socket and ferrule mechanisms 87, 88, 90 and cable 89. The cap 62 or piston head is (FIG. 9) mounted in the pressure chamber 74; piston rod 69, secured thereto, is mounted in the rod support 63 in any suitable manner, for example by roll pin 79. A piston return spring 78 and spring guide pin 86 may be positioned intermediate cap 62 and rod support 63 and the plate 73 closing the forward end of the pressure chamber 74 and mounted thereon by bolt or other means 80. Bushing 72 may be mounted on and further seals the opening in plate 73 for rod 69. Rod bearing or pivot block 71 may be secured, as by pins 84, in the knife support casing 64. The outer end of piston rod 69 may be secured, as at 82, to the head of block 100 which is secured to and intermediate the spaced parallel side walls of the knife holder 67 defining (FIG. 11) a slot 107' therebetween wherein the knife and depending portion 100' (FIG. 9) of block 100 in holder 67 may be reciprocated responsive to reciprocation of the rod 69. Said parts are thus secured together for slidably positioning the score knife holder on the upper edges of the knife support casing 64. The depending portion 100' of block 100 is slidably disposed intermediate the parellel sides of knife casing 64 and is secured as at 81 to the block 100 and has a pin 101 extending therethrough and into slots 107 in the side walls of knife casing 64, to guide the knife assembly on reciprocation of the piston rod 69. As described above and shown in the drawings, the knife mechanisms of this invention include a knife casing 64 having walls disposed in spaced apart, parallel planar relation (FIG. 11) and having elongated planar upper surfaces, the knife 75 being rotatably held in the knife holding member 67: the holding member and the upper surfaces of the knife casing 64 are complementarily formed for planar interengagement and for slidable axially aligned movement of the knife holding member on said upper surfaces of the casing, on actuation of said source. Thus the knife 75 will be moved, in aligned interengagement with the casing, and into contacting engagement with the member 104 (FIG. 9) to be so contacted by the knife, on actuation of the power source 74; the knife holding member 67 has the described means 100 of T-shaped cross section secured thereto as at 81, for slidable interengagement (as at 100') with the walls of the casing. The rod 69 is disposed in bearing block 71 by means 83, the rod pivot block 71 being, in turn, secured, as at 84, to the knife casing 64. The knife casing 64 may be mounted on any desired or convenient flat support surface, such as a plate, beam or other base 102 (FIG. 9) to which a plurality of such knife casings may be secured by any suitable means in adjacent parallel relation. When so secured the rods will thereby be positioned in close alignment; the spacing of the knives, being very narrow, provides a mechanism highly useful and efficient for web scoring and other purposes.

As shown in FIG. 9, the outer end of the score knife holder 67 is provided with preferably angular communicating upper and lower slitted portions 92, 93; axle 66 of the knife 75 may be further provided with hubs or bearings 76. The (wider) upper portion 92 of the slot is proportioned to seat the axle and thus the knife, and axle 66 may have desired snap fit interengagement therewith, while the lower slot portion 93 may be narrower to facilitate spreading the slots for entry of the axle while preventing excess downward movement thereof. Thus knives 75 may be readily individually, selectively, snap-fit or inserted into the knife holders 67 and may be individually removed from the knife holders 67 of a plurality of such units mounted contiguously on beams 102 without disassembly of the parts or disturbing any of the other units of the assembly. Thus, pursuant to the invention, an assembly of a plurality of such knife mechanisms may be positioned in close, contiguous relation and actuated by pressure chambers, for example (FIG. 9) by using an elongated beam or wedge block 102 which may have parallel downwardly tapered sides 103, 103' one of which, for example, 103, may have engagement with L-slots 105 at the bottom of the knife support casing 64; the other block side, 103' may be engaged by any means for wedging or securing the knife casing and block together. To that end, a clamp 65 may be pivotally secured as at 85 to knife support casing 64 and an axially movable member 77 (such as a screw) journalled in and engaging a complementary (such as an internally threaded) portion 106 of the support 64 for movement against the pivoted clamp 65 to move the latter and thereby lock or wedge the support 64 to the bearm or base 102. By this means knife assemblies of the invention may be readily secured to base 102 in the number desired and individual units may be added to and removed and replaced as desired in a simple and highly efficient manner.

In operation, the knife is exposed to the air except for its particular point of contact with the web 104 (FIG. 9) and thus is self-cleaning and may be readily further cleaned if desired by a blast of air or other means. The arms or side walls of knife support casing 64 (FIG. 11) are spaced to define an axial slot 107' to be engaged by the knife holder 67 and (medial) shank 101' of block 100 (FIG. 9) for registration of the parts and to limit the axial movement thereof. The knife holder 67 slides on the upper edges of said side arms or walls of the knife support 64 for guided reciprocation on the knife support 64 on actuation of the piston rod 69 as above described.

While the present invention has been set forth in terms of specific embodiments thereof, variations from these disclosures within the spirit and scope of this invention will thus be made apparent to those skilled in the art. The invention is to be construed to cover such variations, limited only by the scope of the claims appended hereto.

We claim:

1. In a mechanism, including a knife holding member for connection to a power source, for movement of the knife holding member, on actuation of the source, relative to a member to be contacted by the knife:

a. a knife casing having upper and lower arms having free ends disposed in spaced apart, parallel planar relation, said arms having elongated planar surfaces, b. said knife holding member and knife casing arms being complementarily formed for interengaging, slidable axially aligned planar movement of the knife holding member relative to said arms of the casing, on actuation of said power source, c. said knife and knife holding member having complementary means for rotatably and removably receiving said knife in the holding member, d. said knife holding member means for so rotatably and removably receiving said knife including a slotted portion adjacent one end thereof, e. said knife holding member being of such length relative to the upper casing arm that said slotted portion will normally be substantially aligned with the free end of said upper casing arm when said knife holding member is disposed in the casing, to facilitate insertion of the knife into and its removal from said slotted portion of the holder and past said free end of said arm, in a continuous line, out of and into said slot, f. and whereby the so positioned knife holder will be moved outwardly of said casing and into contacting engagement with the member to be so contacted by the knife, on actuation of the power source.

2. In a mechanism as set forth in claim 1 each of said casing arms being formed of a pair of spaced parallel walls, and said knife holder being formed with a pair of spaced parallel walls for so interengaging said walls of the casing, on said axial movement of the knife holding member relative to said arms of the casing.

3. In a mechanism as set forth in claim 1, said casing arm walls being connected at one end.

4. In a mechanism as set forth in claim 1, the knife holder slot being angularly formed and the upper casing arm being also formed angularly at the free end thereof, to substantially correspond to the angle of the knife holder slot, to facilitate removal or replacement of said knife relative to said casing.

5. In a mechanism as set forth in claim 1, said knife holder slot being disposed substantially in line with the free end of the upper casing arm when said knife holder is so disposed in the casing.

6. In a mechanism as set forth in claim 1, said knife holder slot being formed at the lower end thereof of a width substantially narrower than the diameter of the axle.

7. In a mechanism as set forth in claim 1, said power source including a chamber, means connecting said casing and knife holder to said chamber, said chamber and casing being of substantially equal transverse widths, whereby a multiplicity of units, each comprising a chamber and casing may be mounted in contiguous parallel relation, for thus contacting said member in multiple relation.

8. In a mechanism as set forth in claim 1, said knife holder being of a length substantially greater than that of the upper casing arm.

9. In a mechanism as set forth in claim 1, said knife holding member having a free end, means normally urging the casing to a position wherein, when said knife holding member is positioned inwardly of said casing, the knife holder free end will be aligned with the end of the upper casing arm to facilitate insertion and removal of the knife.

10. In a mechanism as set forth in claim 1, said power source being a housing proportioned to substantially equal the width of the casing.

11. In a mechanism as set forth in claim 1, means to secure the casing to a support member, whereby a plurality of casings may be secured to said support member in close parallel relation.

12. In a mechanism as set forth in claim 1, the parts being so proportioned that the knife holder slot will be normally disposed outwardly of the end of the shorter upper arm of the casing, facilitating insertion of the knife into the knife holder and removal therefrom.

13. In a mechanism as set forth in claim 1, said knife having an axle, said holder slotted portion being proportioned for reception of the knife axle therein, said holder being normally positioned to dispose the slotted end portion thererof outwardly of the end of the upper arm of the casing, facilitating insertion of the knife into the slotted end of the holder and removal therefrom.

14. In a mechanism as set forth in claim 1, said end of the upper arm of the casing being inclined facilitating insertion of the knife past said inclined end of the arm, into the holder and removal therefrom.

15. In a mechanism as set forth in claim 1, said end of the upper arm of the casing and said slotted end portion of the holder being correspondingly inclined.

16. In a mechanism, including a knife holding member for connection to a power source, for movement of the knife holding member, on actuation of the source, relative to a member to be contacted by the knife:

a. a knife casing having an arm disposed in extended planar relation to said power source, b. said knife holding member and casing arm being complementarily formed for slidable axial movement of the knife holding member relative to said arm of the casing, on actuation of said source, c. said knife holding member being formed of flexible material, d. said knife holding member having upper and lower faces and having a free end and being provided with a slotted portion adjacent said last mentioned end thererof, e. said slotted portion opening at said upper face of the knife holding member and extending downwardly toward but terminating short of the lower face of the knife holding member, f. said slotted portion of said knife holding member being further formed in spaced relation to its said free end, thereby defining a finger intermediate said slotted portion and said end of said knife holding member, said finger registering with and extending to the plane of the upper face of the knife member, g. said knife having an axle proportioned for reception into said slotted portion of the knife holding member, h. the parts described being so proportioned that said finger thereof will flex on insertion of the knife axle into and removal from said slot.

* * * * *